United States Patent [19]

Allen et al.

[11] Patent Number: 4,676,033

[45] Date of Patent: Jun. 30, 1987

[54] STADIUM BUILDING

[76] Inventors: Christopher M. Allen, 18 Birchview Rd., Ottawa, Ontario, Canada, K2G 3G4; Roderick G. Robbie, 16 Cornish Rd., Toronto, Ontario, Canada, M4T 2E2

[21] Appl. No.: 857,971

[22] Filed: May 1, 1986

[51] Int. Cl.[4] ..... E04B 7/16

[52] U.S. Cl. ..... 52/6; 52/64; 52/66

[58] Field of Search ..... 52/6, 64, 66, 72, 80, 52/82, 86; 47/17

[56] References Cited

U.S. PATENT DOCUMENTS 2,052,217 8/1936 Sibour et al. ..... 52/64 X 3,213,571 10/1965 Olson ..... 52/66

3,370,380 2/1968 Petros ..... 52/64 X 4,381,629 5/1983 Ahn ..... 52/66

4,555,865 12/1985 di Monteforte ..... 52/64 X

FOREIGN PATENT DOCUMENTS 2228405 12/1973 Fed. Rep. of Germany ..... 52/66

*Primary Examiner*—J. Karl Bell

[57] ABSTRACT

A retractable roof, for a stadium building, comprising a central arch separating a pair of ungular end segments, one end segment being fixed, the other end segment being movable into nesting relationship with the fixed end segment, and the central arch being movable to nest above the fixed end segment.

16 Claims, 14 Drawing Figures

STADIUM BUILDING

STATEMENT OF PRIOR ART

The applicant is not aware of any relevant prior art.

FIELD OF THE INVENTION

This invention relates to a stadium building having a retractable roof or dome.

BACKGROUND OF THE INVENTION

Covered stadiums are becoming more common because they provide a controlled environment for outdoor sports and extend the season for such activities. However, an indoor atmosphere is a drawback when the weather is fine because it detracts from the natural environment. To obtain the best of both worlds retractable roofs have been devised to expose the interior of the stadium. Such roofs have been found expensive to construct and/or incomplete in achieving their purpose of approximating complete exposure of the interior. In one type of structure a rectangular roof slides away as a complete unit (Montreal, Canada) while in another type a round roof is opened in the manner of a camera lens shutter. The sliding roof requires additional land for roof storage when open while the shutter roof leaves an overhanging arch.

It is an object of the present invention to provide a stadium having a retractable roof of relatively simple construction giving maximum exposure of the interior.

SUMMARY OF THE INVENTION

Essentially the invention consists of a retractable roof, for a stadium building, comprising a central arch separating a pair of ungular end segments, one end segment being fixed, the other end segment being movable into nesting relationship with the fixed end segment, and the central arch being movable to nest above the fixed end segment.

BRIEF DESCRIPTION OF DRAWINGS

An example embodiment of the invention is shown in the accompanying drawings in which.

DESCRIPTION OF PREFERRED EMBODIMENT

Figure 1:
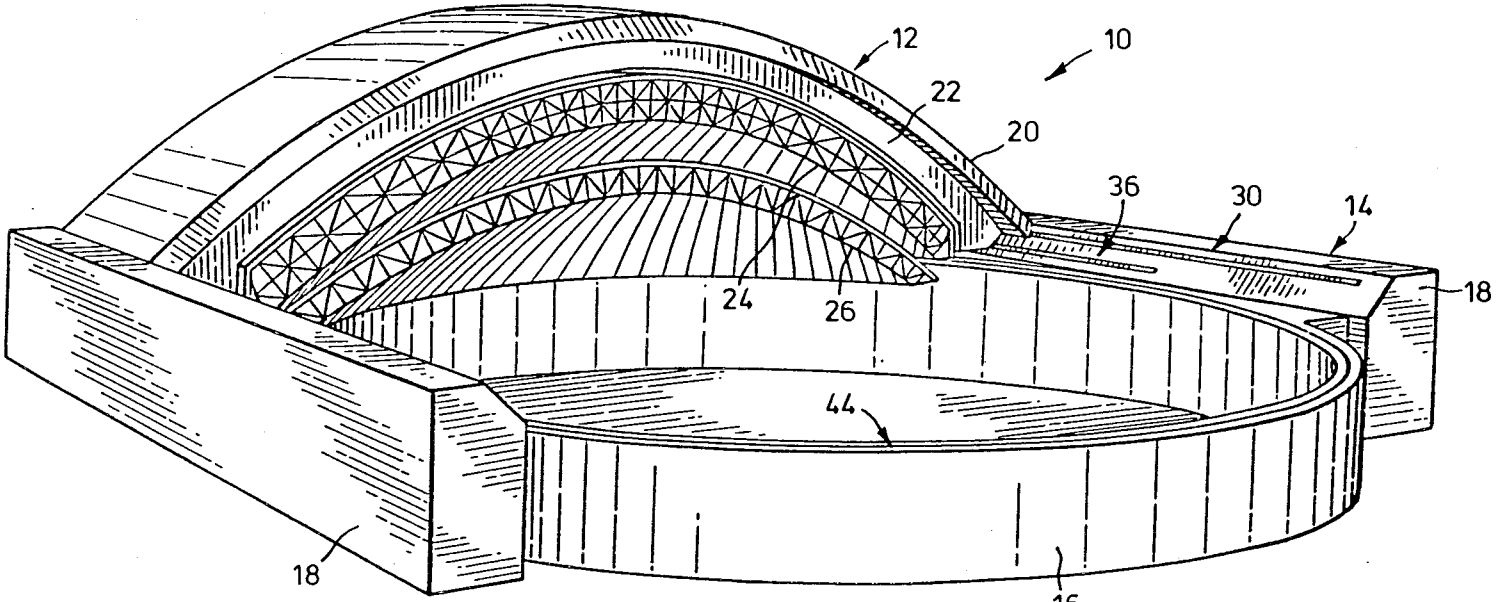
FIG. 1 is a perspective view of a stadium having a roof retracted into an open position.
Figure 2:
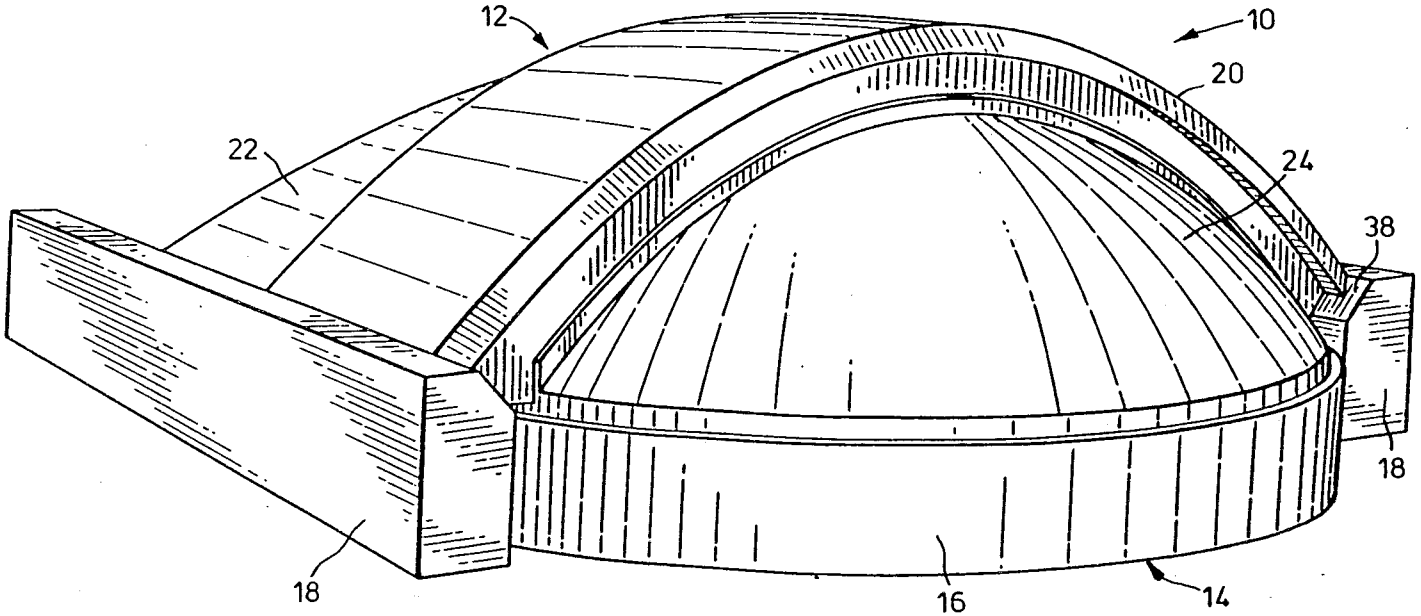
FIG. 2 is a view of the stadium of FIG. 1 showing the roof in a closed position.
Figure 3:
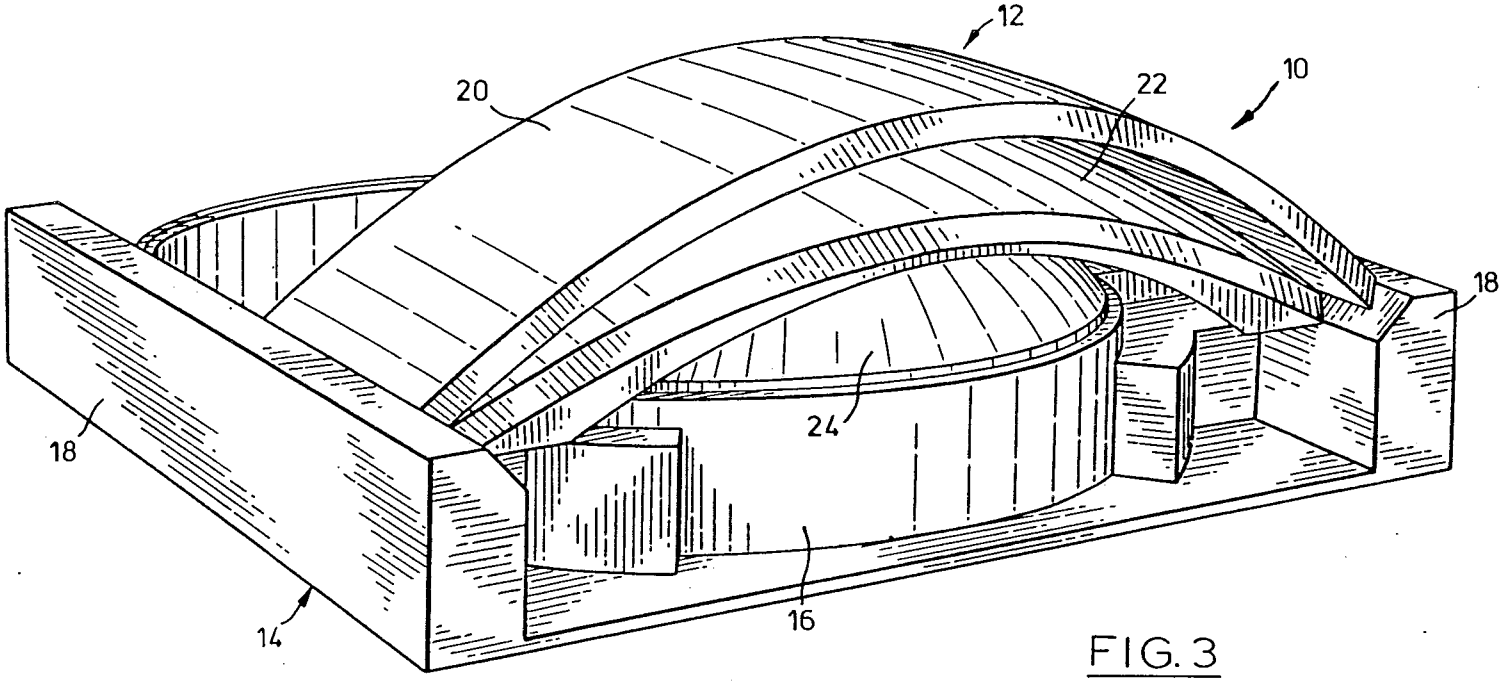
FIG. 3 is a perspective view of the stadium of FIG. 1 from the opposite end thereof.
Figure 4:
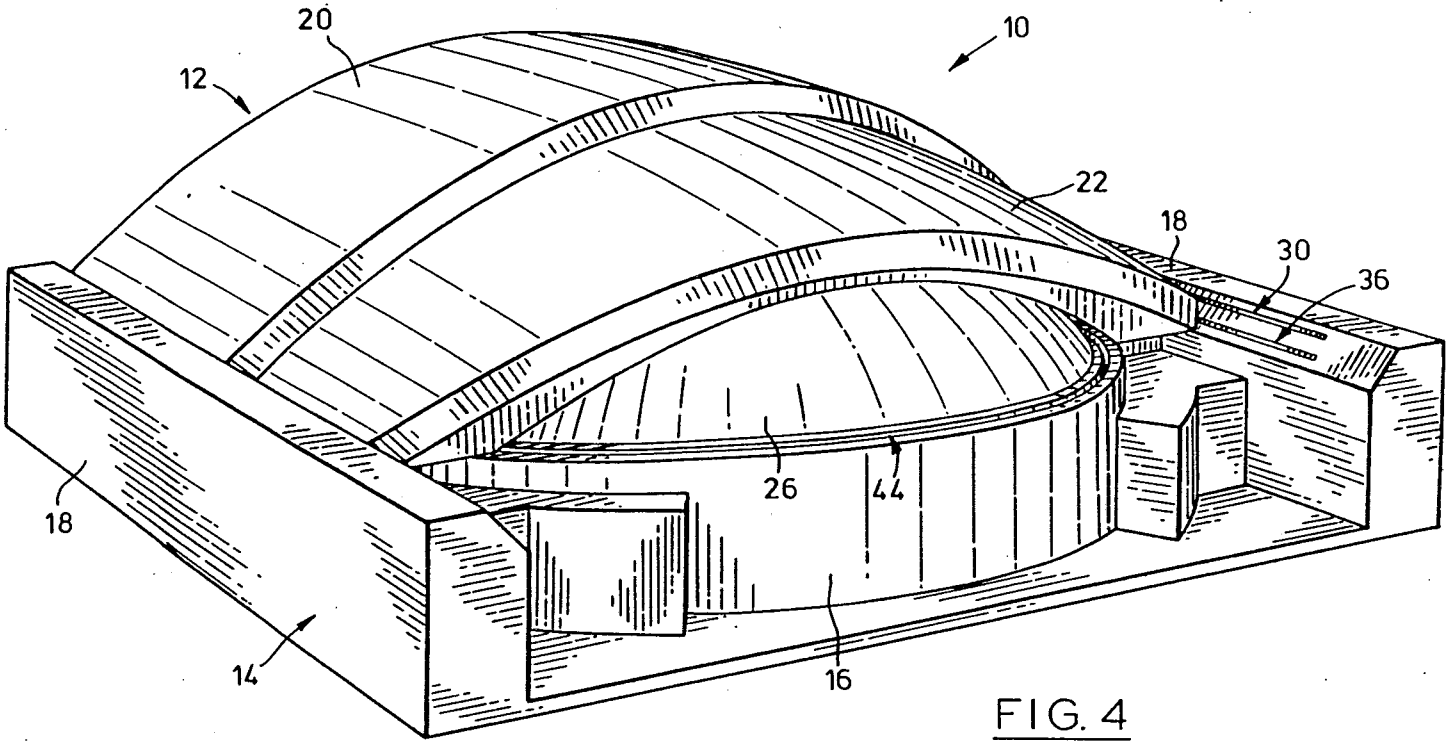
FIG. 4 is a perspective view of the stadium of FIG. 2 from the opposite end thereof.
Figure 5:
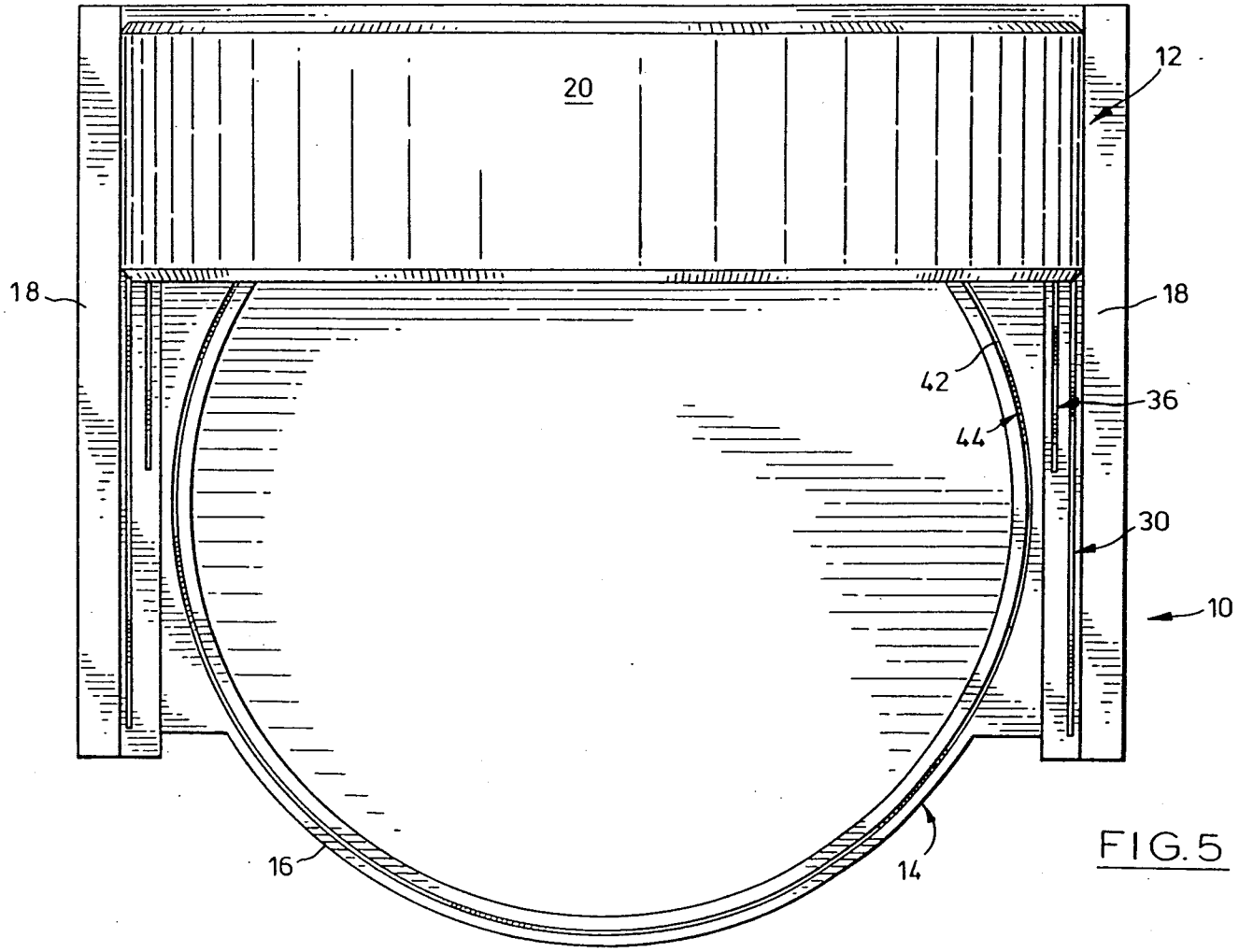
FIG. 5 is a plan view of the stadium of FIG. 1.
Figure 6:
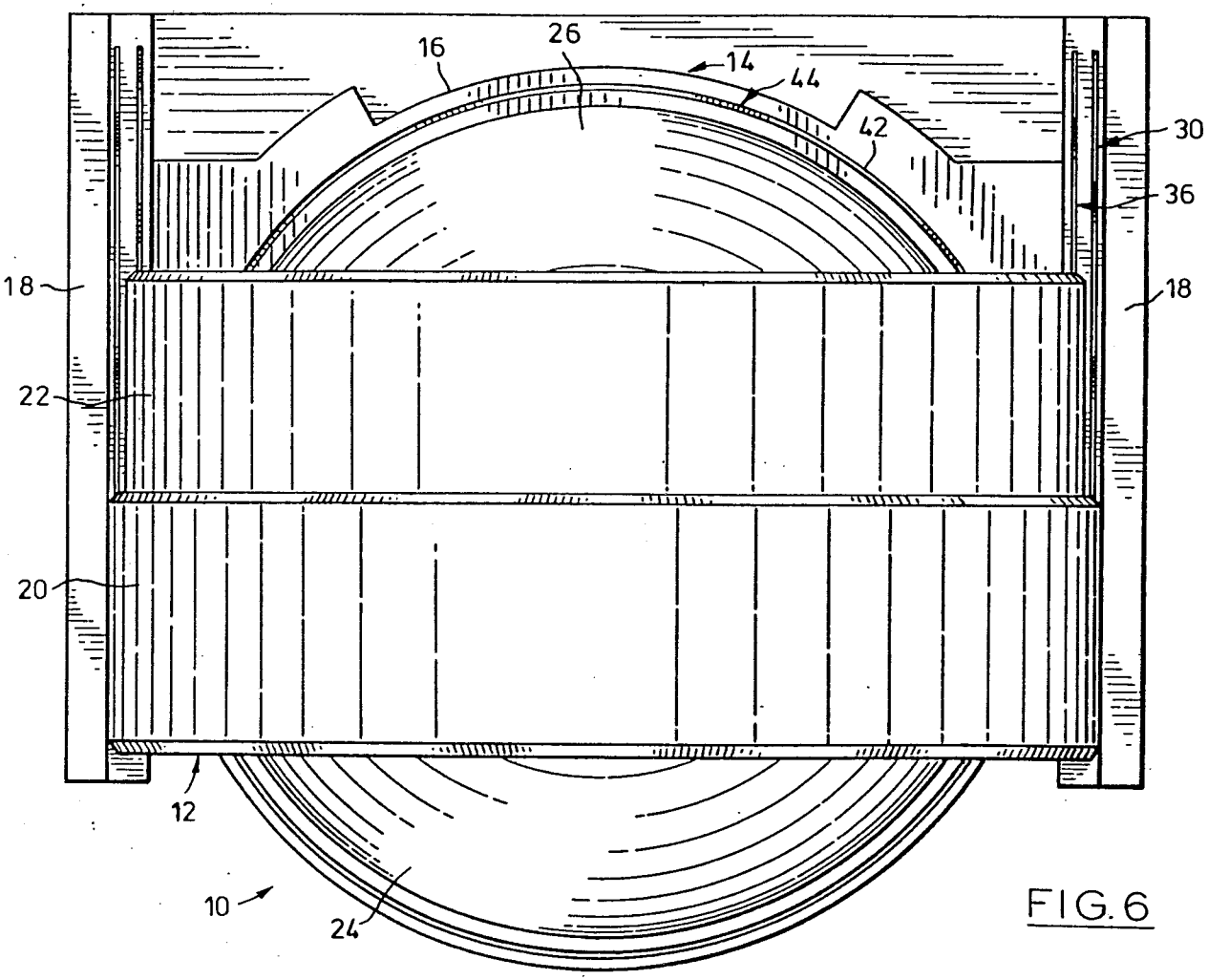
FIG. 6 is a plan view of the stadium of FIG. 2.

The example embodiment shown in the drawings consists of a stadium building 10 having a dome 12 resting on a wall structure 14 comprising a circular wall 16 and a pair of parallel, opposed side walls 18 which are tangential to circular wall 16. Dome 12 consists of a central arch comprising a pair of parallel movable barrel vaults 20 and 22 movably mounted on side walls 18, and a pair of opposed angular end segments 24 and 26 carried by circular wall 16. End segment 24 is movably mounted on a circular wall 16

The manner of mounting movable barrel vaults 20, 22 and movable end segment 24 is shown in FIGS. 7 to 12 of the drawings. Each end of barrel vault 20 is carried on a row of trucks 28 which travel on a set of tracks 30 fixed on opposed parallel shoulders 32 on side walls 18. Each end of barrel vault 22 is carried on a row of trucks 34 which travel on a set of tracks 36 fixed on parallel shoulders 38 of side walls 18. End segment 24 is carried on a row of trucks 40 which travel on a set of tracks 42 in a recess 44 in circular wall 16. Each truck 28, 34 and 40 is joined by a pin connection 46 to a truss 47 its respective vault or segment.

Figure 10:
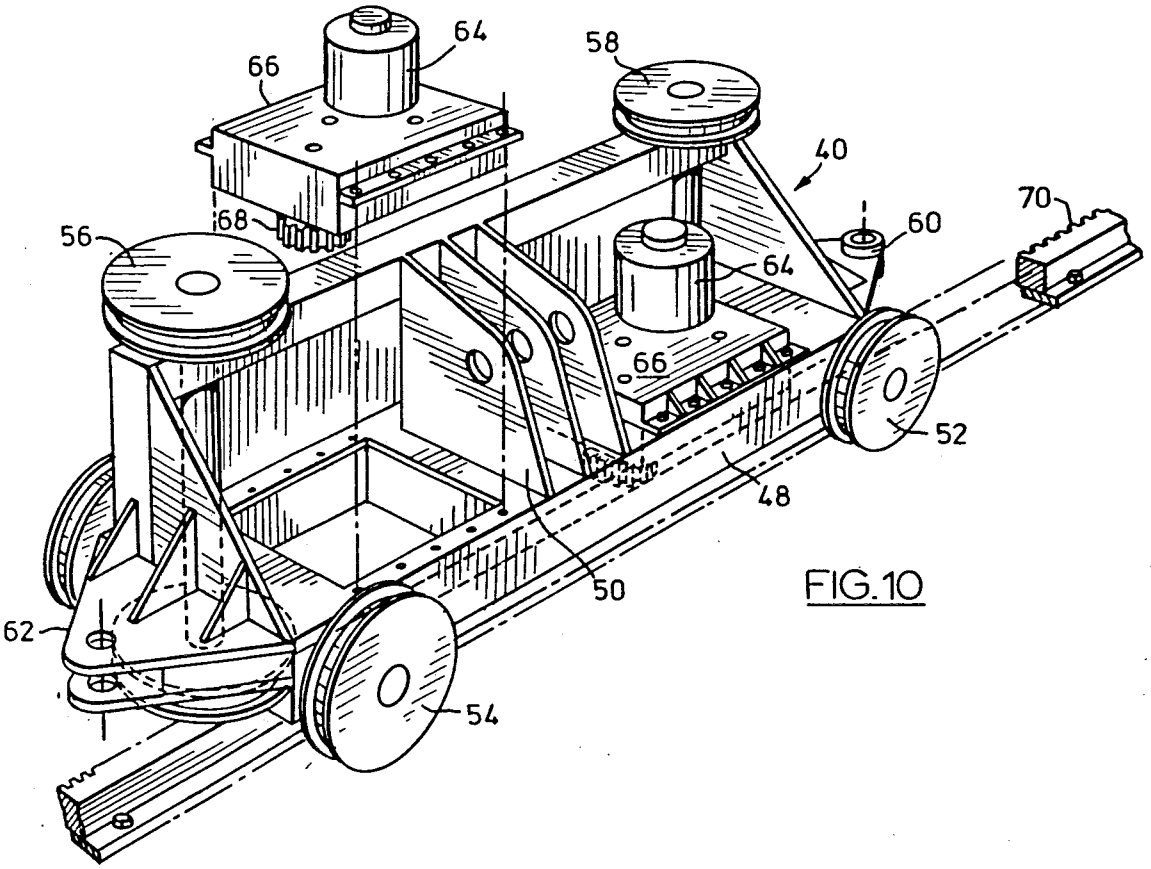
FIG. 10 is a perspective view of a truck of the movable end segment and arches.

Truck 40 is shown in detail in FIG. 10 of the drawings and consists of a carriage frame 48 having a set of fixed anchor plates 50 to which end segment 24 is pin connected. Two spaced pairs of double flanged wheels 52 and 54 are journally mounted in parallel on frame 48 and two further spaced pairs of double flanged wheels 56 and 58 are journally mounted in parallel on frame 48 normal to wheels 52 and 54. One end of frame 48 carries a coupling pin 60 and the other end carries an apertured coupling flange 62 for connecting a row of trucks 40 together. Certain of trucks 40 carry a pair of drive motors 64 each mounted on a gear box 66 which includes a pinion 68 engagable with a rack 70. Trucks 28 and 34 are of the same construction as truck 40 except that wheels 56 and 58 are removed as redundant.

Referring again to FIGS. 8, 9 and 12, each shoulder 32 of side walls 18 carries a pair of parallel, spaced supports 72 with inturned blocks 74. A first pair of rails 76 are fixed on shoulder 32 and a second pair of rails 78 are fixed on blocks 74, to form track 30. Rack 70 is fixed on shoulder 32 between rails 76. Rails 76 and 78 are engaged by pairs of wheels 52 and 54 on truck 28 and rack 70 is engaged by pinions 68. The same arrangement is associated with each shoulder 38 of side walls 18, i.e. supports 72, blocks 74, rails 76 and 78 (to form tracks 32), and rack 70. Recess 44 in circular walls 16 has a pair of secondary recesses 80 and 82 which have fixed pairs of opposed rails 84 and 86 respectively. Recess 44 also has further rails 88 and 90 normal one to the other. Rails 84, 86, 88 and 90 together form track 42.

Figure 11:
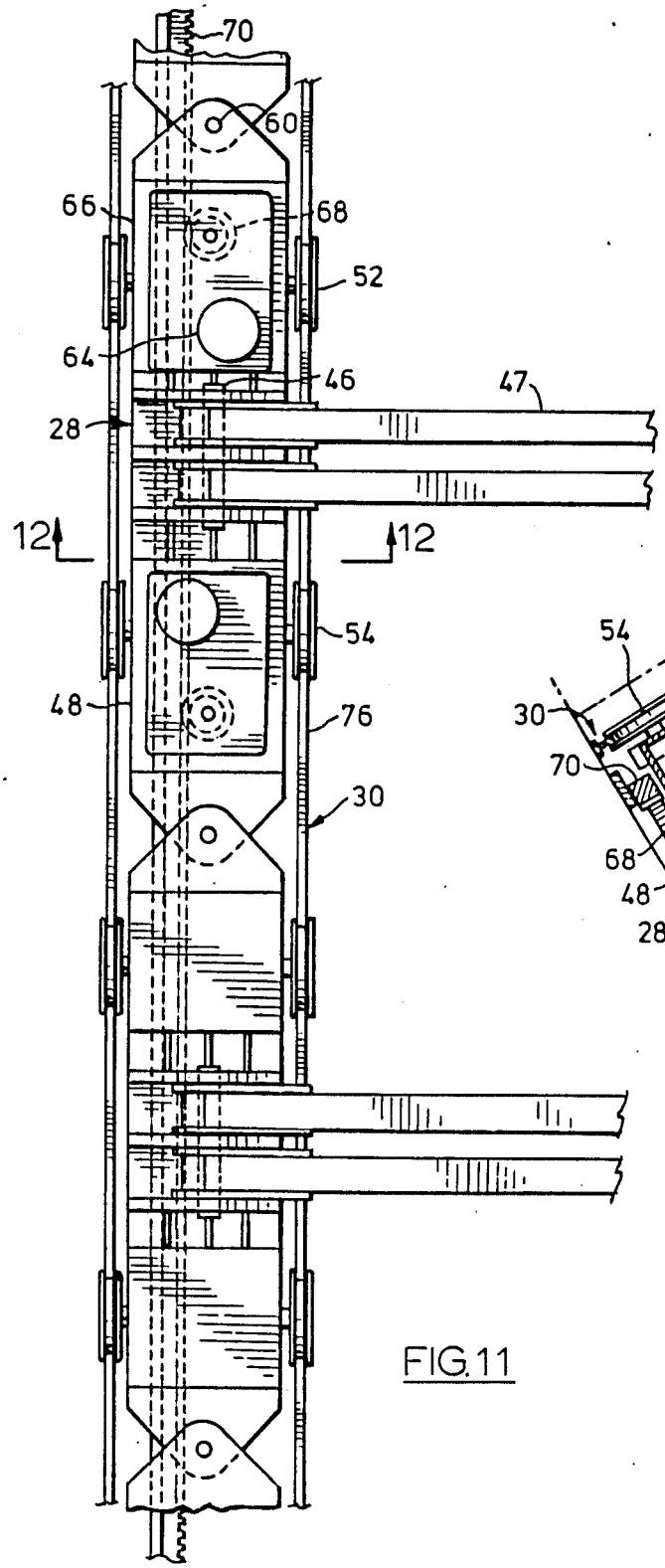
FIG. 11 is a detailed plan view of a plurality of the trucks of one arch.
Figure 12:
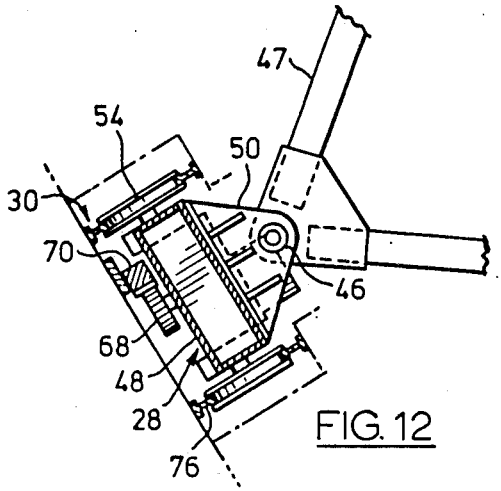
FIG. 12 is a cross-sectional view taken along line 12—12 of FIG. 11.
Figure 13:
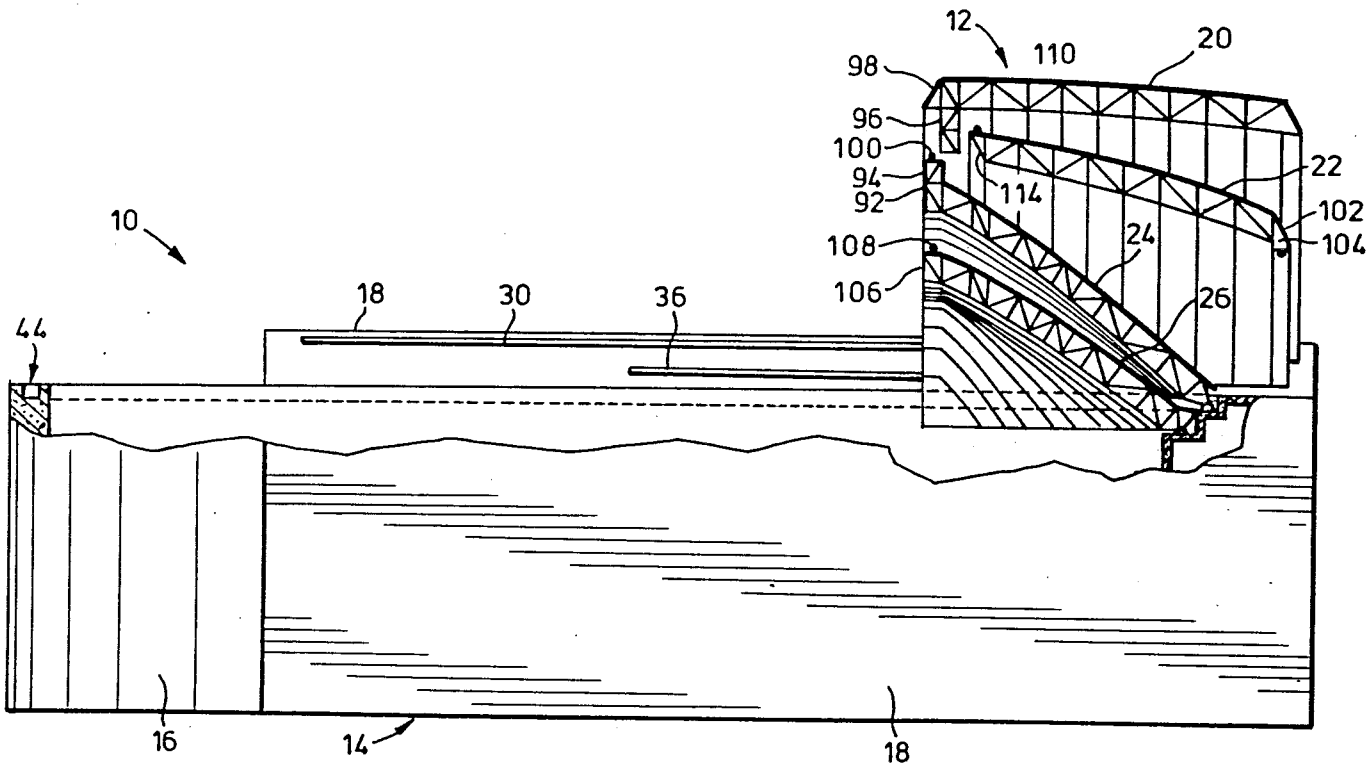
FIG. 13 is a diagrammatic side view of the stadium of FIG. 1 (in open position)

FIGS. 11 and 12 show the arrangement of trucks 28 associated with barrel vault 20. Not every truck 28 is needed to move vault 20 and the drive trucks are sequentially spaced between slave trucks **28*a* which are of the same construction as the drive trucks but do not carry motors 64**.

Figure 7:
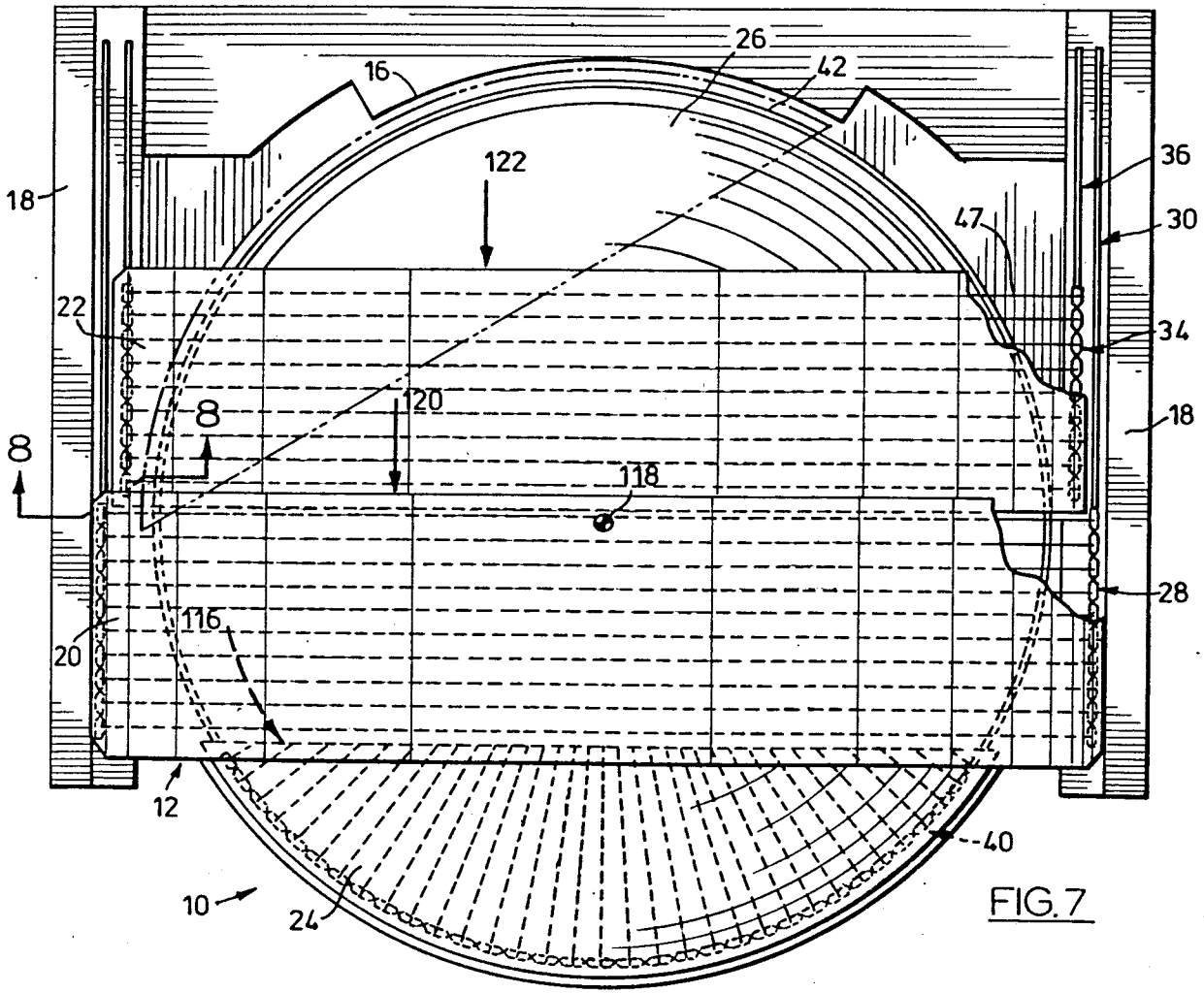
FIG. 7 is a view similar to FIG. 6 showing diagrammatically the truck arrangement and closing movement of the movable end segment and the movable vaults.
Figure 8:
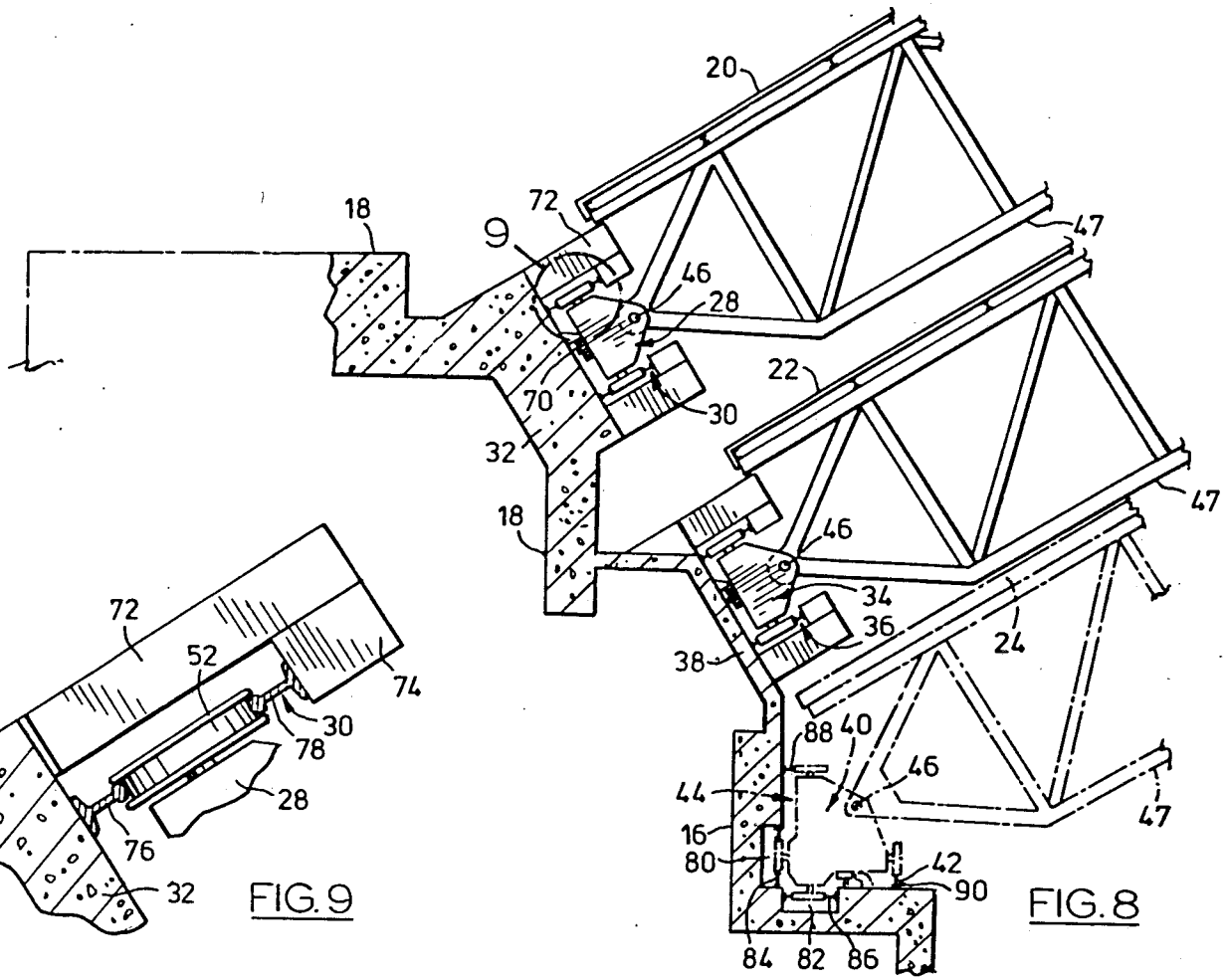
FIG. 8 is a cross-sectional view taken along line 8—8 of FIG. 7 showing the interrelationship between the side walls of the structure and the trucks of the movable end segment and the movable arches.
Figure 9:
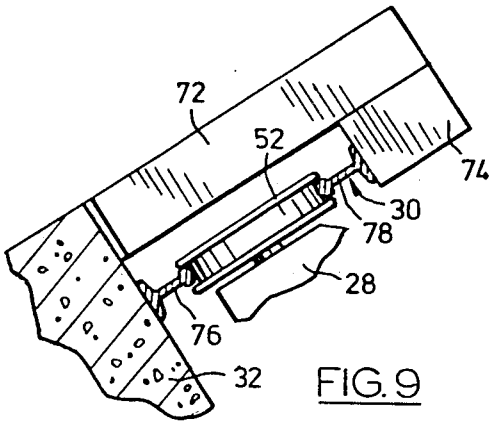
FIG. 9 is a fragmentary view of the area indicated by numeral 9 in FIG. 8.

As seen in FIGS. 1, 3, 5 and 13, dome 12 when open has end segment 24, vault 20, and vault 22 stacked above fixed end segment 26 in nesting position. To close dome 12 into the position shown in FIGS. 2, 4, 6 and 14, end segment 24 and vaults 20, 22 are moved as seen in FIG. 7. More particularly, end segment 24 is rotated on track 42 in the direction of arrow 116 about any imaginary centre of rotation 118, vault 20 is moved linearly on track 36 in the direction of arow 120, and vault 22 is moved linearly on track 32 in the direction of arrow 122.

Figure 14:
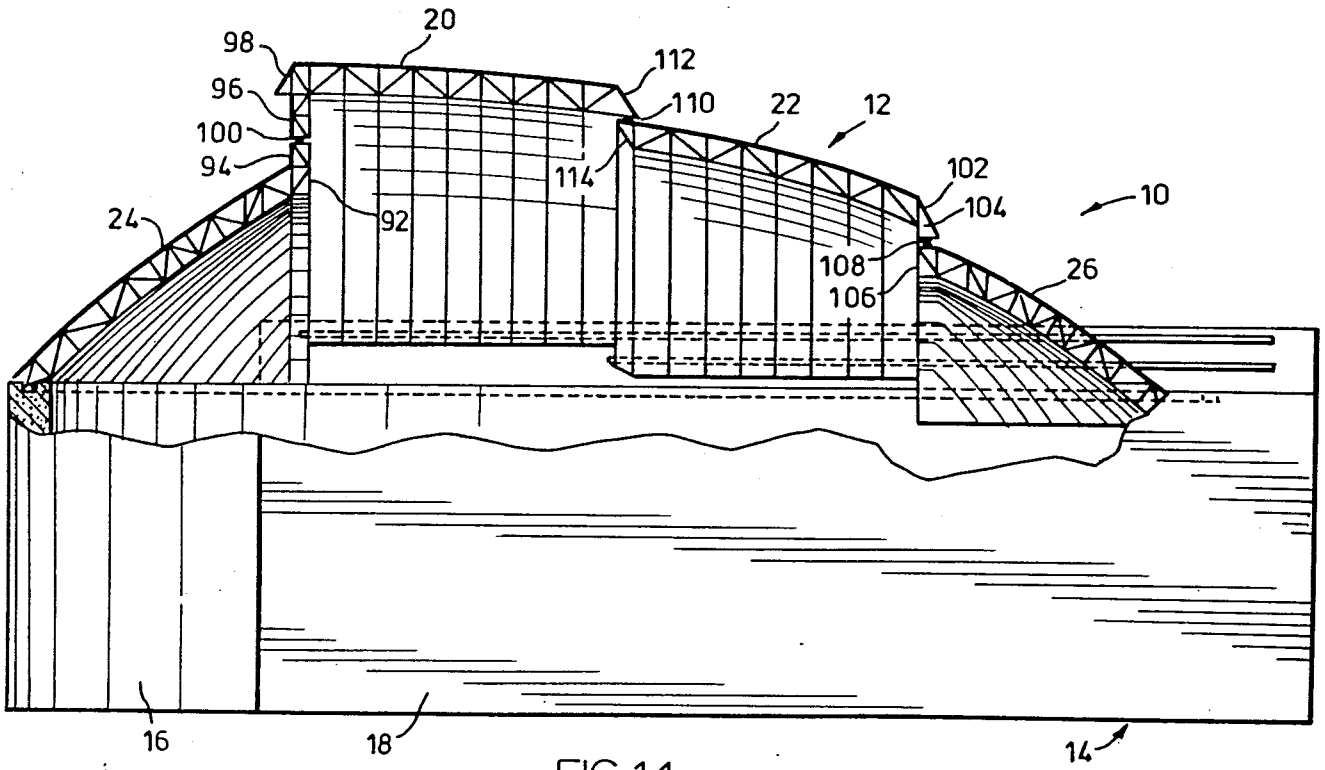
FIG. 14 is a diagrammatic side view of the stadium of FIG. 2 (in closed position).

In the structure as seen in FIG. 14 it will be noted that vaults 20, 22 and end segments 24, 26 carry interengaging means to seal dome 12 in its closed position. In particular, end segment 24 carries at its upper edge 92 an upwardly extending flange 94 which cooperates with a downwardly extending flange 96 on leading edge 98 of vault 20 to form a vertical seal with a suitable sealing element 100. Similarly trailing edges 102 of vault 22 carries a downwardly extending flange 104 which cooperates with upper edge 106 of end segment 26 to close the gap between the vault and the segment together with a sealing element 108. A sealing element 110 between trailing edge 112 of vault 20 and leading edge 114 of vault 22 completes the sealing of dome 12.

We claim:

1. In a stadium building, a retractable roof comprising a central arch separating a pair of angular end segments, one end segment being fixed, the other end segment being movable into nesting relationship with the fixed end segment, and the central arch being movable to nest above the fixed end segment.

2. A stadium building as claimed in claim 1 in which the central arch comprises at least two barrel vaults in side by side relationship, the two barrel vaults being movable into nesting relationship one with the other above the fixed end segment.

3. A stadium building as claimed in claim 1 including an assembly of parallel rails having the arch movably mounted thereon and an arcuate rail assembly having the movable end segment movably mounted thereon.

4. A stadium building as claimed in claim 3 in which the rail assemblies include means to carry an uplift load.

5. A stadium building as claimed in claim 2 in which the barrel vault adjacent the movable end segment is movable to nest above the barrel vault adjacent the fixed end segment.

6. A stadium building as claimed in claim 1 in which the central arch is externally convex in lateral cross-section.

7. A stadium building as claimed in claim 1 in which the central arch is flat in lateral cross-section.

8. A stadium building as claimed in claim 2 in which the barrel vaults are flat in cross-section and each barrel vault includes a flange downwardly extending from one side edge thereof to meet the adjacent end segment.

9. A stadium building as claimed in claim 2 in which the barrel vaults are externally convex in cross-section and the barrel vault adjacent the movable end segment includes a flange extending downwardly from one side edge thereof to meet the movable end segment.

10. A stadium building as claimed in claim 1 in which the stadium building comprises a circular wall and a pair of parallel, opposed side walls tangential to the circular wall, an assembly of parallel rails fixed along the side walls and having the arch movably mounted thereon, an arcuate rail assembly fixed along the circular wall and having the movable end segment mounted thereon, and the fixed end segment being mounted on the circular wall.

11. A stadium building as claimed in claim 10 in which the central arch comprises at least two barrel vaults in side by side relationship, the two barrel vaults being movable into nesting relationship one with the other above the fixed end segment.

12. A stadium building as claimed in claim 11 in which each barrel vault carries a plurality of trucks at each end thereof engaging the parallel rail assembly, each truck having a plurality of flanged wheels journally mounted thereon, the rail assembly comprising a plurality of rails engaging the wheels whereby both upward wind loads and downward weight loads are accommodated, and drive means mounted on at least one of the trucks.

13. A stadium building as claimed in claim 12 in which said drive means comprises a drive motors and a pinion driven thereby, a rack mounted on each side wall, and a pinion engaging the rack and drive by the motor.

14. A stadium building as claimed in claim 13 in which the drive means comprises a drive motor, a ratchet mounted on the side wall, and a pinion engaging the ratchet and driven by the motor.

15. A stadium building as claimed in claim 10 in which the movable end segment carries a plurality of trucks engaging the arcuate rail assembly, each truck having a plurality of flanged wheels journally mounted thereon, the rail assembly comprising a plurality of rails engaging the wheels whereby both upward wind loads and downward weight loads are accommodated, and drive means mounted on at least one of the trucks.

16. A stadium building as claimed in claim 15 in which said drive means comprises a drive motor and a pinion driven thereby, a rack mounted on the circular wall, and a pinion engaging the rack and drive by the motor.

* * * * *

UNITED STATES PATENT AND TRADEMARK OFFICE

CERTIFICATE OF CORRECTION

PATENT NO. : 4,676,033

DATED : June 30, 1987

INVENTOR(S) : Christopher M. Allen; Roderick G. Robbie

It is certified that error appears in the above-identified patent and that said Letters Patent is hereby corrected as shown below:

Column 2, line 16, "angular" should read --ungular--;

Claim 1, line 2, "angular" should read --ungular--.

Signed and Sealed this

Seventh Day of February, 1989

*Attest:*

DONALD J. QUIGG

*Attesting Officer*

*Commissioner of Patents and Trademarks*